US007617778B2

(12) United States Patent
Henriksson et al.

(10) Patent No.: US 7,617,778 B2
(45) Date of Patent: Nov. 17, 2009

(54) IMPACT CARTRIDGE UNIT FOR MILITARY EXERCISE

(75) Inventors: Johan Henriksson, Bankeryd (SE); Jesper Wiberg, Huskvarna (SE); Ingemar Emricson, Bankeryd (SE); Jonas Malm, Jönköping (SE)

(73) Assignee: SAAB AB, Linköping (SE)

( * ) Notice: Subject to any disclaimer, the term of this patent is extended or adjusted under 35 U.S.C. 154(b) by 313 days.

(21) Appl. No.: 11/628,861

(22) PCT Filed: Jun. 9, 2005

(86) PCT No.: PCT/EP2005/052676

§ 371 (c)(1),
(2), (4) Date: Dec. 8, 2006

(87) PCT Pub. No.: WO2005/121692

PCT Pub. Date: Dec. 22, 2005

(65) Prior Publication Data

US 2007/0245920 A1 Oct. 25, 2007

(30) Foreign Application Priority Data

Jun. 11, 2004 (EP) ..... 04013785

(51) Int. Cl.
*F42B 8/18* (2006.01)
*F42B 8/20* (2006.01)

(52) U.S. Cl. ..... 102/498; 102/502; 102/529

(58) Field of Classification Search ..... 102/395, 102/444, 445, 447, 482, 487, 488, 498, 513, 102/529, 502; 42/105; 89/1.52
See application file for complete search history.

(56) References Cited

U.S. PATENT DOCUMENTS

| | | | | | |
|---|---|---|---|---|---|
| 1,900,790 | A | * | 3/1933 | Brandt | 102/485 |
| 2,459,854 | A | * | 1/1949 | Swift, Jr. | 89/1.1 |
| 2,592,434 | A | * | 4/1952 | Krasnow | 102/513 |
| 3,712,218 | A | * | 1/1973 | Fay | 102/216 |
| 3,732,821 | A | | 5/1973 | Royer | |
| 4,448,106 | A | * | 5/1984 | Knapp | 89/1.11 |
| 4,867,034 | A | * | 9/1989 | Trosky et al. | 89/1.11 |
| 5,246,372 | A | * | 9/1993 | Campagnuolo et al. | 434/11 |
| 5,326,268 | A | | 7/1994 | Campagnuolo | |
| 5,351,623 | A | * | 10/1994 | Kissel et al. | 102/498 |
| 5,474,452 | A | | 12/1995 | Campagnuolo | |

(Continued)

FOREIGN PATENT DOCUMENTS

WO WO 94/17358 A 8/1994

OTHER PUBLICATIONS

European Search Report—May 30, 2008.

(Continued)

*Primary Examiner*—Bret Hayes
(74) *Attorney, Agent, or Firm*—Venable LLP; Eric J. Franklin

(57) ABSTRACT

An impact cartridge unit for military exercise including a cartridge including a propulsive agent and on top thereof a grenade simulating member simulating a low velocity grenade to be fired by a firearm or the like. The grenade simulating member includes an arrangement adapted to simulate a detonation of a low velocity grenade and trigger associated therewith for triggering the detonation.

15 Claims, 2 Drawing Sheets

U.S. PATENT DOCUMENTS 5,481,979 A * 1/1996 Walder ..... 102/498
5,750,918 A * 5/1998 Mangolds et al. ..... 102/502
5,872,326 A * 2/1999 Manhart ..... 102/439
5,996,503 A * 12/1999 Woodall et al. ..... 102/498
6,065,404 A 5/2000 Lind et al.
6,619,211 B1 9/2003 Haeselich
2002/0108526 A1 8/2002 Wes et al.

OTHER PUBLICATIONS

PCT/ISA/210—International Search Report.

* cited by examiner

IMPACT CARTRIDGE UNIT FOR MILITARY EXERCISE

CROSS-REFERENCE TO RELATED APPLICATIONS

This application claims priority to European patent application 04013785.3 filed 11 Jun. 2004 and is the national phase under 35 U.S.C. § 371 of PCT/EP2005/052676 filed 9 Jun. 2005.

TECHNICAL FIELD OF THE INVENTION AND PRIOR ART

The present invention relates to an impact cartridge unit for military exercise comprising a cartridge containing a propulsive agent and on top thereof a member simulating a low velocity grenade to be fired by a firearm or the like.

"Impact cartridge unit" is to be interpreted as something really fired or launched during military exercise or training for hitting a target but not being harmful to the participants of said military exercise as would a live such unit be.

"Low velocity grenade" is a grenade similar to a hand-grenade with respect to range. However, in some situations a hand-grenade may not be thrown as exactly as desired for obtaining the effect aimed at and/or the distance to the target is too long. This may for instance be the case when there is a wish to deliver a grenade from the outside of a building through a window into a room on the fourth floor of the building. In such a case a low velocity grenade being a part of a said impact cartridge unit may be fired through for instance an attachment applied on a conventional firearm with an accuracy required through said window. Thus, the propulsive agent and said cartridge are adapted to the grenade so that it will "fly" according to a path similar to a conventional throw towards a target, but a grenade of this type differs from a hand-grenade by having a higher accuracy and a considerably larger range.

A known impact cartridge unit for military exercise of the type defined in the introduction has a member simulating a low velocity grenade formed by a member of low density material flying and landing as a live low velocity grenade without hurting anyone. However, the simulation of a live grenade is restricted to the movement path of the grenade. Such low velocity grenades are often fired into landscape pockets, buildings and the like, where it is not possible to see the landing position thereof. This means that in many situations during a military exercise the effect of a live such low velocity grenade may not be accurately simulated through this known impact cartridge unit, but rough estimations have to be done for calculating whether any participants of the exercise have been affected or not.

It would be possible to determine the position of impact of such a low velocity grenade in some situations through the use of instrument engineering, such as GPS, radio networks and the like. However, it is very complicated to determine the impact position of the grenade from data concerning the direction of the firearm and calculate the ballistic path thereof. Such a calculation model has to consider the appearance of the terrain, fixed obstacles such as buildings, windows (Did the grenade hit the wall close to the window or did it go through the window?), dynamic obstacles, such as opened/closed doors, movable objects (vehicle platforms) and so on. Furthermore, the use of GPS will not deliver reliable results indoors.

SUMMARY OF THE INVENTION

The object of the present invention is to provide an impact cartridge unit for military exercise of the type defined above making it possible to better simulate a live low velocity grenade than such impact cartridge units already known.

This object is obtained by providing said grenade simulating member with an arrangement adapted to simulate a detonation of a low velocity grenade and means associated therewith for triggering said detonation.

Thanks to the simulation of a detonation of a low velocity grenade this will "inform" the surroundings about the impact position thereof. Thus, measures may be taken for influencing the surroundings, including participants of the military exercise, in the same way as would a live low velocity grenade. Thus, no complicated calculation system is needed for exactly determining the position of the grenade, since it will in any way have the same influence in said military exercise as a live grenade.

According to a preferred embodiment of the invention said member comprises a shell containing an electronic unit adapted to simulate said detonation and to be triggered by said triggering means. By using such an electronic unit in said grenade simulating member a suitable simulation of a detonation of a low velocity grenade may be accomplished without any harmful influence whatsoever upon participants of the military exercise.

According to another preferred embodiment of the invention said electronic unit comprises a transmitter adapted to influence by its transmission equipment used for a military exercise for obtaining an effect upon participants of said exercise, such as soldiers and the like, similar to that of a live grenade in combat. This constitutes an efficient solution to the problem of simulating a detonation of a low velocity grenade.

According to another preferred embodiment of the invention said transmitter is adapted to transmit light for simulating said detonation, and it is advantageous to use for example coded visible/invisible as said light.

According to another preferred embodiment of the invention said transmission is adapted to transmit sound for simulating said detonation, and another possibility is to transmit radio signals for said simulation. Thus, the electronic unit with the transmitter may be designed for adapting them to the overall system used for a military exercise.

"Triggering means" as used here is to be interpreted very broadly and includes also the case of designing said arrangement so that it will be influenced by the firing of the impact cartridge unit to start a count-down to the simulation of a detonation.

According to a preferred embodiment of the invention said triggering means comprises a sensor adapted to trigger said arrangement upon sensing a firing of said unit, and this may for instance be obtained by a sensor sensing the shock or acceleration at the firing instant or a mechanical sensor sensing the separation of said member from the cartridge at the firing instant.

According to another preferred embodiment of the invention said triggering means comprises a sensor adapted to trigger said arrangement upon sensing an impact of said grenade simulating member after firing. This way of triggering is advantageous for simulating certain types of low velocity grenades.

According to another preferred embodiment of the invention said shell of the grenade simulating member also contains a delay unit adapted to delay said detonation simulation with respect to the triggering thereof by said triggering means. Such a delay unit may be a clock, a fuse or anything else co-operating with the triggering means.

According to another preferred embodiment of the invention said grenade simulating member also comprises means adapted to emit smoke, dust or gas mixture in connection with an impact of said grenade simulating member. This means that the effect of a low velocity grenade may be even better simulated, since the detonation thereof normally results in a cloud of splinter, dust and the like simulated by the emission of said smoke, dust or gas mixture.

According to another preferred embodiment of the invention said grenade simulating member comprises a transmitter adapted to automatically start some sort of transmission with a delay of a predetermined period of time with respect to said detonation simulation for enabling said grenade simulating member to be found after completion of a said military exercise. Such a period of time may for instance be an hour after said detonation simulation, and this feature makes it possible to recycle the grenade simulating member or parts thereof, such as an electronic unit included therein, for repeated use in subsequent military exercises, thus lowering the cost for the impact cartridge unit.

Further advantages as well as advantageous features of the invention will appear from the following description and the other dependent claims.

BRIEF DESCRIPTION OF THE DRAWINGS

With respect to the appended drawings, below follows a specific description of a preferred embodiment of the invention cited as an example.

In the drawings.

DETAILED DESCRIPTION OF A PREFERRED EMBODIMENT OF THE INVENTION

Figure 1:
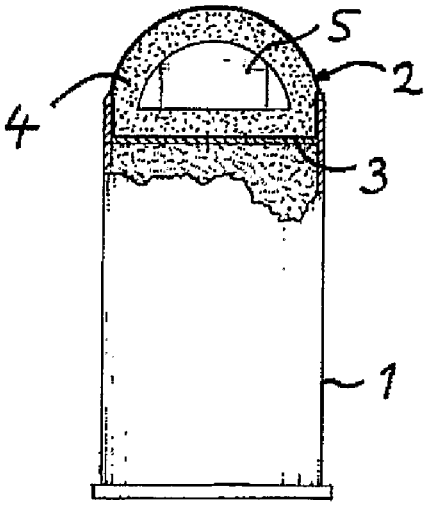
FIG. 1 is a schematic, partially sectioned view of an impact cartridge unit for military exercise according to a preferred embodiment of the invention.

An impact cartridge unit for military exercise according to a preferred embodiment of the invention is schematically illustrated in FIG. 1. It comprises a conventional cartridge 1 containing a propulsive agent or booster charge and being of the same type as a cartridge used for firing a live low velocity grenade. This cartridge may typically have a calibre of 40 mm for firing with a grenade pistol or a rifle attachment, but also other calibres are possible. The range thereof may be 400 m depending on grenade simulated. A member 2 simulating a low velocity grenade is arranged on top of the cartridge 1 and comprises a rear metal plate 3 to be influenced by the propulsive agent and a shell 4 designed not to hurt any person thereby. The shell 4 also contains an electronic unit 5 schematically indicated through a box. The electronic unit 5 is adapted to simulate a detonation of a low velocity grenade after firing the impact cartridge unit by a firearm or the like.

The function and further features of this impact cartridge unit according to the invention will now be described with reference to FIGS. 2-4.

Figure 2:
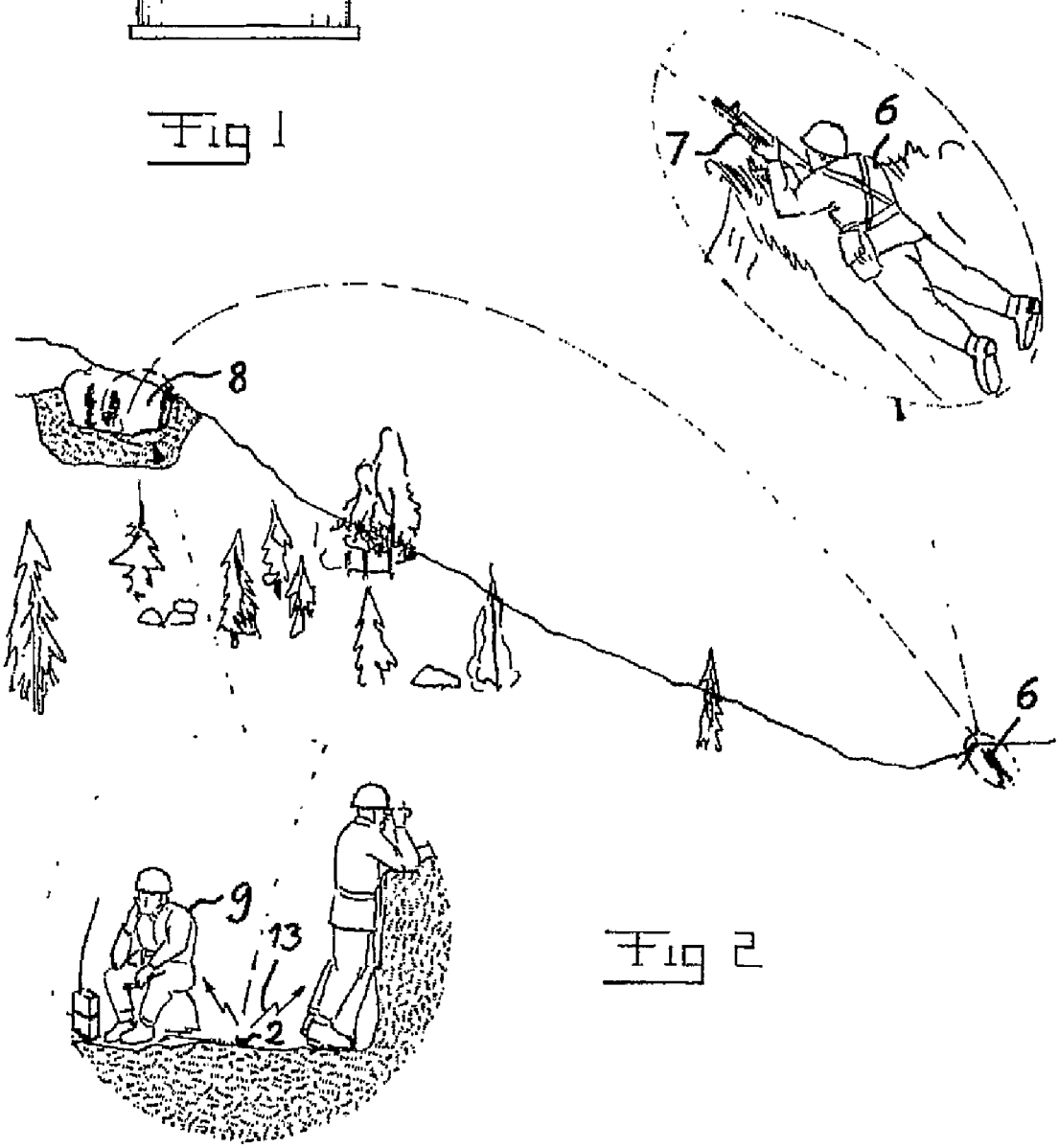
FIGS. 2 and 3 show two possible situations for the use of an impact cartridge unit according to FIG. 1 in a military exercise.

It is shown in FIG. 2 how an impact cartridge unit for military exercise in accordance with the invention is fired by a soldier 6 through a firearm attachment 7 in a loop for hitting a target 8 of a group of soldiers 9 in a cleft behind a small hill. The electronic unit 5 of the grenade simulating member includes or is associated with a sensor 10 used for triggering said detonation and sensing the instant of firing by being influenced by the shock or the acceleration or the physical separation of the cartridge and the grenade simulating member fired. The sensor 10 may also sense the impact of the grenade simulating member 2. Information from the sensor 10 is sent to a control unit 11, which with a possible delay after receiving a signal from the sensor 10 orders a simulation of a detonation of a grenade. This is done by sending a signal to a transmitter 12 starting to transmit light, sound, radio signals or the like as indicated by the arrows 13 in FIG. 2. The control unit 11 may also send a signal to means 14 emitting smoke, dust or a gas mixture for making the simulated detonation visible and even more realistic for the participants of the military exercise. The transmission from the transmitter 12 is adapted to influence equipment used for the military exercise for obtaining an effect upon participants, as the soldiers 9, similar to that of a live grenade. This means that soldiers who had been killed or injured by a live grenade will be subjected to similar effect.

The electronic unit also comprises a further transmitter 15 adapted to automatically start a beacon transmission (for example sound, light or radio) with a delay of a predetermined period of time, such as an hour or the like, with respect to said detonation simulation for enabling said grenade simulating member to be found after completion of a said military exercise. This means that the grenade simulating member or at least the electronic unit thereof may be recycled for being mounted on a cartridge 1 for repeated use thereof.

Figure 3:
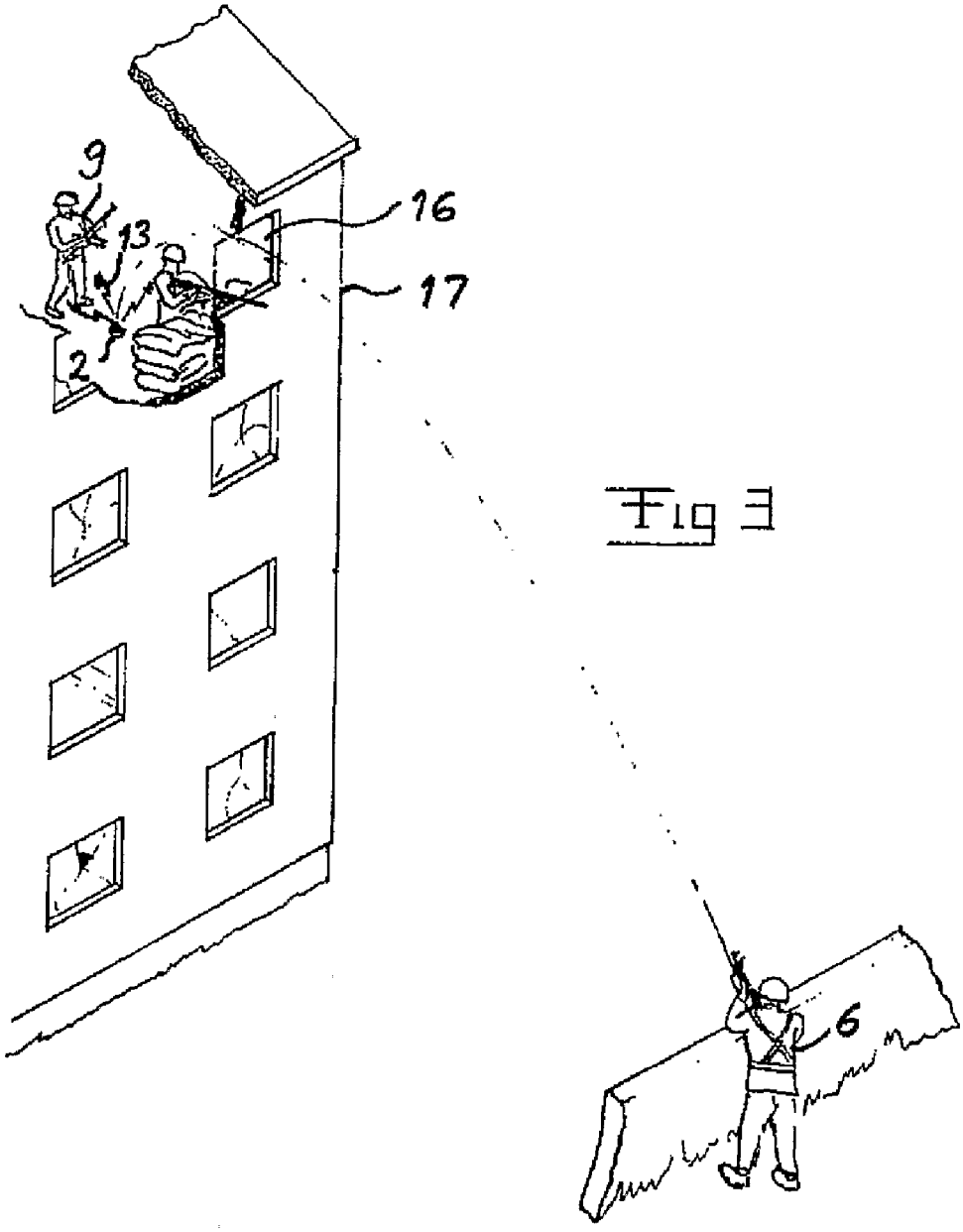
Figure 4:
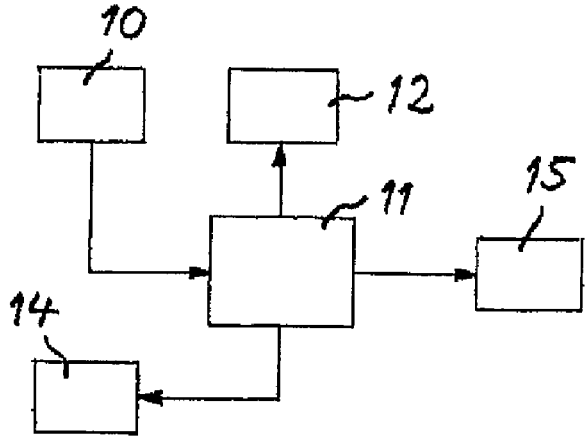
FIG. 4 is a very schematic view illustrating the way of function of a grenade simulating member in an impact cartridge unit according to FIG. 1.

FIG. 3 illustrates a further possible situation for use of an impact cartridge unit according to the invention in a military exercise. The soldier 6 is here firing the member 2 through a window 16 and into a flat on the fourth floor of a building 17. It is shown how the member through its transmitter transmits light, sound, radio signals or the like 13 for effecting the target/soldier.

The invention is of course not in any way restricted to the preferred embodiment described above, but the appended claims cover a lot of modifications thereof.

The relative dimensions of the cartridge and the grenade simulating member shown in the Figures are only for illustrating purpose, and said member may for instance have another outer shape, a shell made of several different layers and the like.

It is not necessary that said grenade simulating member includes means for emission of smoke, dust or gas mixture in connection with an impact of the grenade simulating member.

Although favourable, the further transmitter for finding said member is neither a necessity.

The impact cartridge unit according to the invention may also be fired or launched through other equipment than those shown in the Figures.

The invention claimed is:

1. An impact cartridge unit for military exercise, comprising:

a cartridge comprising a propulsive agent; and a grenade simulating member operative to simulate a grenade to be fired by a firearm, said grenade simulating member comprising an arrangement adapted to simulate a detonation of the grenade by generating a first signal, the grenade simulating member further comprising a trigger for triggering said simulated detonation, the trigger comprising a sensor configured to trigger the arrangement upon sensing a firing of the cartridge unit or upon sensing an impact of the grenade simulating member after firing, and the grenade simulating member further comprising a locating transmitter configured to automatically start to transmit with a delay of a predetermined period of time with respect to the simulated detonation a second signal for enabling said grenade simulating member to be found after completion of the military exercise.

2. The impact cartridge unit according to claim 1, wherein said grenade simulating member further comprises a shell including an electronic unit adapted to generate said first signal to simulate said detonation and to be triggered by said trigger.

3. The impact cartridge unit according to claim 2, wherein said electronic unit comprises a detonation-simulating transmitter adapted to generate the first signal to influence equipment used for a military exercise for obtaining an effect upon participants of said exercise, similar to that of a live grenade.

4. The impact cartridge unit according to claim 3, wherein said detonation-simulating transmitter is adapted to transmit visible and/or invisible light for simulating said detonation.

5. The impact cartridge unit according to claim 4, wherein said detonation-simulating transmitter is adapted to transmit light in the form of coded laser beams.

6. The impact cartridge unit according to claim 3, wherein said detonation-simulating transmitter is adapted to transmit sound for simulating said detonation.

7. The impact cartridge unit according to claim 3, wherein said detonation-simulating transmitter is adapted to transmit radio signals for simulating said detonation.

8. The impact cartridge unit according to claim 2, wherein said shell of the grenade simulating member further comprises a delay unit adapted to delay said detonation simulation with respect to the triggering thereof by said trigger.

9. The impact cartridge unit according to claim 1, wherein said grenade simulating member further comprises an emitter adapted to emit smoke, dust or gas mixture in connection with an impact of said grenade simulating member.

10. The impact cartridge unit according to claim 1, wherein said locating transmitter is adapted to transmit sound, light or radio signals.

11. The impact cartridge unit according to claim 1, wherein said grenade simulating member or a part thereof is adapted to be recycled for being mounted on a said cartridge for repeated use thereof.

12. The impact cartridge unit according to claim 1, wherein said grenade simulating member comprises a shell.

13. The impact cartridge unit according to claim 1, wherein the impact cartridge unit is dimensioned to have a range shorter than 500 m.

14. The impact cartridge unit according to claim 1, wherein the impact cartridge unit is dimensioned to have a range up to 400 m.

15. The impact cartridge unit according to claim 1, wherein the grenade simulating member is arranged on top of the cartridge.

* * * * *